US008393273B2

(12) United States Patent
Weeks et al.

(10) Patent No.: US 8,393,273 B2
(45) Date of Patent: Mar. 12, 2013

(54) BULLETS, INCLUDING LEAD-FREE BULLETS, AND ASSOCIATED METHODS

(75) Inventors: Robert Weeks, Bend, OR (US); Robert Nosler, Bend, OR (US); Mike Lake, Bend, OR (US)

(73) Assignee: Nosler, Inc., Bend, OR (US)

( * ) Notice: Subject to any disclaimer, the term of this patent is extended or adjusted under 35 U.S.C. 154(b) by 315 days.

(21) Appl. No.: 12/687,859

(22) Filed: Jan. 14, 2010

(65) Prior Publication Data

US 2010/0175576 A1 Jul. 15, 2010

Related U.S. Application Data

(60) Provisional application No. 61/144,688, filed on Jan. 14, 2009, provisional application No. 61/232,389, filed on Aug. 7, 2009.

(51) Int. Cl.
*F42B 12/74* (2006.01)
*F42B 30/02* (2006.01)

(52) U.S. Cl. ..... 102/506; 102/509; 102/516

(58) Field of Classification Search ..... 102/506, 102/507, 508, 509, 510, 516, 517
See application file for complete search history.

(56) References Cited

U.S. PATENT DOCUMENTS

| | | | |
|---|---|---|---|
| 2,409,307 | A | 10/1946 | Patch et al. |
| 3,463,047 | A | 8/1969 | Germershausen |
| 3,785,293 | A | 1/1974 | Barr et al. |
| 3,951,035 | A | 4/1976 | Dautzenberg et al. |
| 4,353,305 | A | 10/1982 | Moreau et al. |
| 4,428,295 | A | 1/1984 | Urs |
| 4,685,397 | A | 8/1987 | Schimeker et al. |
| 4,777,883 | A | 10/1988 | Chevich |
| 4,811,666 | A | 3/1989 | Lutfy |
| 4,881,465 | A | 11/1989 | Hooper et al. |
| 4,942,818 | A | 7/1990 | Saxby |
| 4,945,836 | A | 8/1990 | Michaels |
| 4,949,644 | A | 8/1990 | Brown |
| 4,949,645 | A | 8/1990 | Hayward et al. |
| 4,958,572 | A | 9/1990 | Martel |

(Continued)

FOREIGN PATENT DOCUMENTS

| | | | |
|---|---|---|---|
| GB | 965889 | A | 8/1964 |
| GB | 1091551 | A | 11/1967 |

(Continued)

OTHER PUBLICATIONS

International Search Report and Written Opinion, International Application No. PCT/US2010/021088, Applicant: Nosler, Inc., mailed Apr. 2, 2010, 11 pages.

(Continued)

*Primary Examiner* — James Bergin
(74) *Attorney, Agent, or Firm* — Perkins Coie LLP

(57) ABSTRACT

Bullets, including lead-free bullets with frangible cores, are described herein. In some embodiments, a bullet includes a jacket having an inner surface defining a cavity having an open end and a closed end. The bullet also includes a lead-free core positioned within the cavity and extending from the closed end to a first intermediate portion of the cavity. The core includes a plurality of particles that are compacted within the cavity to form the core. The bullet also includes a seal positioned within the cavity and extending from the first intermediate portion to a second intermediate portion of the cavity. The seal abuts the inner surface of the jacket, thereby substantially sealing off the core within the cavity. The bullet may also include a polymeric tip having a forward portion projecting forward from the open end and a rearward portion extending rearward into the cavity.

60 Claims, 10 Drawing Sheets

U.S. PATENT DOCUMENTS 5,014,759 A 5/1991 Holzbach et al.
5,078,054 A 1/1992 Ashok et al.
5,131,123 A 7/1992 Brooks et al.
5,160,805 A 11/1992 Winter
5,187,325 A 2/1993 Garvison
5,214,237 A 5/1993 McArthur
5,237,930 A 8/1993 Belanger et al.
5,259,320 A 11/1993 Brooks et al.
5,279,787 A 1/1994 Oltrogge
5,293,822 A 3/1994 Peddie
5,357,866 A 10/1994 Schluckebier et al.
5,385,101 A 1/1995 Corzine et al.
5,394,597 A 3/1995 White
5,399,187 A 3/1995 Mravic et al.
5,454,325 A 10/1995 LeBlanc
5,500,183 A 3/1996 Noordegraaf et al.
5,528,989 A 6/1996 Briese
5,535,678 A 7/1996 Brown et al.
5,616,642 A 4/1997 West et al.
5,621,186 A 4/1997 Carter
5,665,808 A 9/1997 Bilsbury et al.
5,679,920 A 10/1997 Hallis et al.
5,686,693 A 11/1997 Jakobsson et al.
5,722,035 A 2/1998 Matysik et al.
5,760,331 A 6/1998 Lowden et al.
5,763,819 A 6/1998 Huffman
5,767,438 A 6/1998 Lang et al.
5,786,416 A 7/1998 Gardner et al.
5,789,698 A 8/1998 Beal
5,834,683 A 11/1998 Benvegnu'
5,847,313 A 12/1998 Beal
5,852,255 A 12/1998 Hallis et al.
5,852,858 A 12/1998 Hallis et al.
5,877,437 A 3/1999 Oltrogge
5,880,398 A 3/1999 Crilly et al.
5,894,645 A 4/1999 Hallis et al.
5,913,256 A 6/1999 Lowden et al.
5,917,143 A 6/1999 Stone
5,950,064 A 9/1999 Robinson et al.
5,963,776 A 10/1999 Lowden et al.
6,016,754 A 1/2000 Enlow et al.
6,024,021 A 2/2000 Schultz
6,036,996 A 3/2000 Martin
6,048,379 A 4/2000 Bray et al.
6,070,532 A 6/2000 Halverson
6,071,359 A 6/2000 Wisniewski et al.
6,074,454 A 6/2000 Abrams et al.
6,085,661 A 7/2000 Halverson et al.
6,090,178 A 7/2000 Benini
6,101,949 A 8/2000 Maucourt et al.
6,112,669 A 9/2000 Mravic et al.
6,115,894 A 9/2000 Huffman
6,145,441 A 11/2000 Woodall et al.
6,149,705 A 11/2000 Lowden et al.
6,158,350 A 12/2000 Pulcini
6,158,351 A 12/2000 Mravic et al.
6,174,494 B1 1/2001 Lowden et al.
6,182,574 B1 2/2001 Giannoni
6,257,149 B1 7/2001 Cesaroni et al.
6,263,798 B1 7/2001 Benini
6,268,316 B1 7/2001 Tanaka et al.
6,317,946 B1 11/2001 Beal
6,371,029 B1 4/2002 Beal
6,375,971 B1 4/2002 Hansen
6,439,124 B1 8/2002 Enlow et al.
6,457,417 B1 10/2002 Beal
6,517,774 B1 2/2003 Bray et al.
6,530,328 B2 3/2003 Burczynski et al.
6,536,352 B1 3/2003 Nadkarni et al.
6,546,875 B2 4/2003 Vaughn et al.
6,551,375 B2 4/2003 Siddle et al.
6,561,070 B2 5/2003 Weber
6,581,523 B2 6/2003 Beal
6,626,114 B2 9/2003 Beal
6,629,485 B2 10/2003 Vaughn et al.
6,655,295 B2 12/2003 Baumgartner et al.
6,691,623 B1 2/2004 Stone
6,694,888 B2 2/2004 Jopson et al.
6,745,698 B2 6/2004 Beal
6,749,662 B2 6/2004 Bueneman et al.
6,776,101 B1 8/2004 Pickard
6,776,818 B1 8/2004 Nilsson
6,799,518 B1 10/2004 Williams
6,805,057 B2 10/2004 Carr et al.
6,892,647 B1 5/2005 Stone
6,899,034 B1 5/2005 Glover et al.
6,916,354 B2 7/2005 Elliott
6,935,217 B2 8/2005 Beal
6,935,243 B2 8/2005 Dippold
6,973,879 B1 12/2005 McElroy et al.
7,000,524 B2 2/2006 Beal
7,036,433 B2 5/2006 Beal
7,069,834 B2 7/2006 Beal
7,127,996 B2 10/2006 Muth
7,150,233 B1 12/2006 Eberhart
7,159,519 B2 1/2007 Robinson et al.
7,162,942 B2 1/2007 Dippold
7,178,462 B2 2/2007 Beasley
7,217,389 B2 5/2007 Amick
7,229,750 B2 6/2007 Suzuki et al.
7,232,473 B2 6/2007 Elliott
7,243,588 B2 7/2007 Beal
7,267,794 B2 9/2007 Amick
7,278,357 B2 10/2007 Keith et al.
7,299,733 B2 11/2007 Eberhart et al.
7,299,750 B2 11/2007 Schikora et al.
7,322,297 B2 1/2008 Yaich
7,328,658 B2 2/2008 Robinson et al.
7,353,756 B2 4/2008 LeaSure
7,380,503 B2 6/2008 Williams et al.
7,392,746 B2 7/2008 Hansen
7,399,334 B1 7/2008 Wei et al.
7,404,359 B2 7/2008 Muskat et al.
7,422,720 B1 9/2008 Wei et al.
7,509,911 B2 3/2009 Muskat et al.
7,555,987 B2 7/2009 Powers, Jr.
7,607,394 B2 * 10/2009 Cesaroni ..... 102/516
2001/0050020 A1 12/2001 Davis et al.
2002/0005137 A1 1/2002 Stone
2002/0026967 A1 3/2002 Buenemann et al.
2002/0124759 A1 9/2002 Amick
2002/0178963 A1 12/2002 Halverson
2003/0101891 A1 6/2003 Amick
2004/0129165 A1 7/2004 Cesaroni
2004/0159262 A1 8/2004 LeaSure
2005/0008522 A1 1/2005 Amick
2005/0016411 A1 1/2005 Amick
2005/0066846 A1 3/2005 Leblanc et al.
2005/0263029 A1 12/2005 Kumar
2006/0027129 A1 2/2006 Kolb et al.
2006/0048668 A1 3/2006 Williams
2006/0107863 A1 5/2006 Powers
2006/0144281 A1 7/2006 Williams et al.
2007/0000404 A1 1/2007 Eberhart
2007/0006770 A1 1/2007 Herrlinger
2007/0017408 A1 1/2007 Ferruelo Nicolas et al.
2007/0017409 A1 1/2007 Mansfield et al.
2007/0026793 A1 2/2007 Perdomo
2007/0089629 A1 4/2007 Marx
2007/0119523 A1 5/2007 Amick
2007/0131131 A1 6/2007 Stock et al.
2007/0131132 A1 6/2007 Beal
2007/0163459 A1 7/2007 MacDougall
2007/0181031 A1 8/2007 Romero
2007/0193468 A1 8/2007 Sauvestre
2007/0204758 A1 9/2007 Spatz et al.
2008/0000379 A1 1/2008 Hansen
2008/0035008 A1 2/2008 Riess et al.
2008/0216700 A1 9/2008 Martini Filho
2008/0230964 A1 9/2008 Wohlfromm et al.

FOREIGN PATENT DOCUMENTS

GB 2278423 A 11/1994
WO WO-9308442 4/1993
WO WO-03027602 4/2003

OTHER PUBLICATIONS

Barnes Bullets, Barnes MPG Multi-Purpose Green, available at: http://www.barnesbullets.com/images/2009BarnesCatalog.web.pdf, 2009 catalog, 1 page.

"Glaser Safety Slug, "Wikipedia, http://en.wikipedia.org/w/index.php?title=Glaser Safety Slug&printable=yes, accessed Jan. 12, 2010, 2 pages.

Barnes Bullets, "Bullets Made the Way They Ought'a Be," http://www.barnesbullets.com/products/rifle/varmint-grenade/accessed Jul. 27, 2009, 4 pages.

Barnes Bullets, M/LE RRLP Bullets. http:www.barnesbullets.com/products/mle-tactical-bullets/mle-rrlp-bullets, accessed on Jul. 27, 2009, 3 pages.

Barnes® Varmint Grenade, available at: http://www.barnesbullets.com/images/2008%0Barnes%20Catalog s.pdf, 2008 catalog, 1 page.

Barnes® Varmint Grenade, 2009 catalog. available at: http://www.barnesbullets.com/images/2009BarnesCatalog.web.pdf, 2009 catalog, 1 page.

International Preliminary Examination Report—Translation, International Application No. PCT/DE2002/003523, mailed Jan. 26, 2004, 4 pages.

Remington: Premier® Disintegrator® Varmint, Frangible and Lead-Free, Explosively Volatile on Game, 2009 catalog, 1 page.

* cited by examiner

BULLETS, INCLUDING LEAD-FREE BULLETS, AND ASSOCIATED METHODS

CROSS-REFERENCE TO RELATED APPLICATIONS

This application claims the benefit of U.S. Provisional Patent Application No. 61/144,688 filed Jan. 14, 2009 and U.S. Provisional Patent Application No. 61/232,389 filed Aug. 7, 2009, each of which is incorporated by reference herein in its entirety.

TECHNICAL FIELD

This application describes bullets, including lead-free bullets with frangible cores.

BACKGROUND

Lead has been used as a material in projectiles for years. For example, lead has been used as a component in disintegrating bullets (bullets designed to disintegrate into fine powder upon exiting the barrel of a firearm from which they are fired) as well as frangible bullets (bullets designed to break apart upon impacting a target).

In recent years there has been a trend to produce bullets containing no lead. However, such lead-free bullets may not have the same performance characteristics as bullets containing lead because the materials used do not have the same properties as lead.

Accordingly, a lead-free bullet that meets or exceeds the performance of a comparable bullet containing lead would have significant utility.

DETAILED DESCRIPTION

1. Overview

Figure 1A:
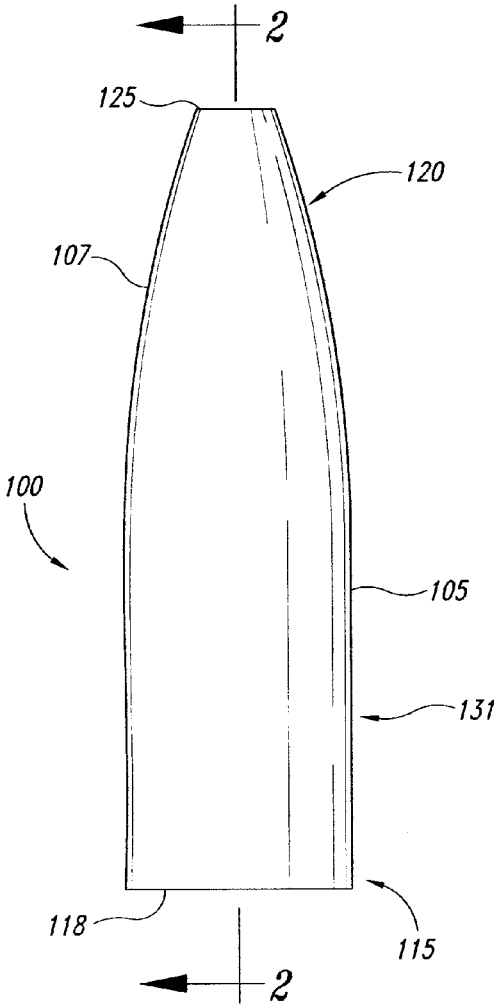
FIGS. 1A and 1B are enlarged side and top views and FIG. 1C is an isometric view of a bullet in accordance with an embodiment.

This application describes bullets, including lead-free bullets having frangible cores. Several embodiments are set forth in FIGS. 1A-9 and the following text to provide a thorough understanding of particular embodiments. Moreover, several other embodiments can have different configurations, components or procedures than those described herein. A person skilled in the art will understand, therefore, that certain aspects of the embodiments shown in FIGS. 1A-9 may not be necessary.

In one embodiment, the bullet includes a copper jacket having an inner surface defining a cavity. The cavity has an open end and a closed end. The bullet also includes a lead-free core positioned within the cavity and extending from the closed end to a first intermediate portion of the cavity. The core includes a compacted plurality of copper particles. The particles, prior to compaction, have a dimension of from about 0.003 inches to about 0.038 inches. The plurality of particles are compacted within the cavity to form the lead-free core. The bullet also includes a light-cured adhesive positioned within the cavity and extending from the first intermediate portion of the cavity to a second intermediate portion of the cavity. The light-cured adhesive forms a seal abutting the inner surface of the lead-free jacket, thereby substantially sealing off the lead-free core within the cavity. The bullet also includes a polymeric tip having a forward portion projecting forward from the open end and a rearward portion extending rearward into the cavity.

In another embodiment, the bullet includes a jacket defining a cavity having a closed end and an open end, and a core positioned within the cavity and extending from the closed end to a first intermediate portion of the cavity. The core includes a plurality of particles. The particles have a dimension of from about 0.003 inches to about 0.038 inches. The bullet also includes a seal positioned within the cavity and extending from the first intermediate portion of the cavity to a second intermediate portion of the cavity. Among other things, the seal may prevent ingress into the core of foreign matter that enters through the open end of the cavity.

In another embodiment, the bullet includes a lead-free jacket having a tail section with a base, an intermediate section extending from the tail section, a nose section having an ogived outer surface extending from the intermediate section to a terminus, an opening at the terminus, and an inner surface defining a cavity extending from the opening to the base. The bullet also includes a lead-free core positioned within the cavity. The lead-free core extends from the base to a first intermediate portion of the cavity. The lead-free core includes a plurality of compacted metal granules. The metal granules, prior to compaction, have a dimension of from about 0.003 inches to about 0.038 inches. The metal granules have outer surfaces, and the lead-free core includes a layer on the outer surfaces of the metal granules. For example, the layer may include a lubricant that at least partially covers the outer surfaces of the metal granules.

In another embodiment, the bullet includes a jacket having a nose section having an ogived outer surface and a tail section with a generally annular base defining an opening. The jacket defines a cavity extending from the opening to a closed end of the cavity. The bullet also includes a core positioned within the cavity. The core extends from the closed end of the cavity to a first intermediate portion of the cavity. The core may be composed of a single unitary piece of material, or the core may include a plurality of compacted metal particles. The bullet also includes a seal positioned within the cavity between core and the opening defined by the annular base.

In another embodiment, the bullet includes a body having an opening and a cavity that extends from the opening to a closed end at an intermediate portion of the body. The body also includes a surface that at least partially defines the cavity. The bullet also includes sealing material positioned on a portion of the surface. The sealing material has a solid state and previously had a non-solid state. Among other things, the sealing material may prevent foreign matter that enters the cavity through the opening from contacting the portion of the surface on which the sealing material is positioned.

Methods of forming a bullet in accordance with some embodiments are also described. One embodiment of such a method, for example, includes disposing a lead-free core within a cavity of a lead-free jacket. The lead-free core includes a plurality of particles. The particles have a dimension of from approximately 0.003 inches to approximately 0.038 inches. The method also includes positioning a seal proximate to the lead-free core. Among other things, the seal may prevent ingress into the lead-free core of foreign matter.

Methods of forming sealing materials on a bullet are also described. One embodiment of such a method, for example, includes applying sealing material having a non-solid state to a bullet. The bullet has an opening and a cavity that extends from the opening to a closed end at an intermediate portion of the body. The body includes a surface that at least partially defines the cavity. The sealing material may be applied via the opening to at least a portion of the surface of the cavity. The method further includes changing the non-solid state of the sealing material to a solid state. Among other things, the sealing material in the solid state may prevent foreign matter that enters the cavity through the opening from contacting the portion of the surface to which the sealing material is applied.

2. Embodiments of Bullets and Methods of Making Bullets

Figure 1B:
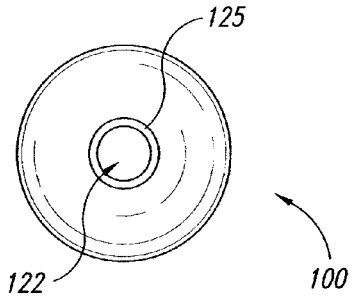
Figure 1C:
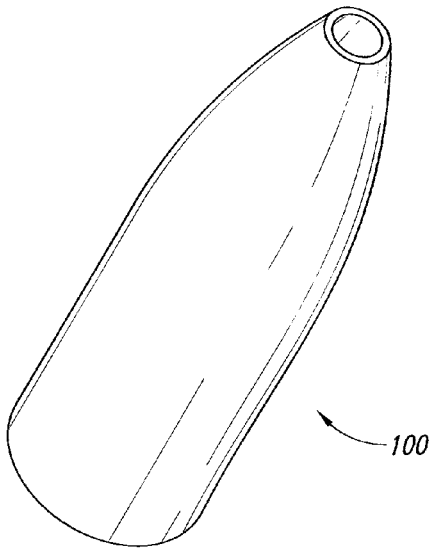

FIGS. 1A and 1B are enlarged side and top views and FIG. 1C is an isometric view of a bullet 100 in accordance with an embodiment. The bullet 100 includes a jacket 105 having a nose section 120, a generally cylindrical intermediate section 131 and a generally cylindrical tail section 115 with a substantially flat base 118. The nose section 120 of the illustrated embodiment has an ogived outer surface 107 and a generally annular forward terminus 125. In some embodiments, the outer surface of the nose section may not be ogived but instead may have other shapes (e.g., the outer surface may be co-planar with the intermediate section, it may be substantially straight, the outer surface may form a right cone, a truncated cone, etc.). The forward terminus 125 has a generally circular opening 122 that opens to a cavity extending rearward from the forward terminus 125 to the flat base 118. As seen in FIG. 1B, the opening 122 in the forward terminus 125 can be substantially circular. The jacket 105 can be a continuous piece of material composed of unalloyed copper or copper alloyed with another metal, such as zinc. One suitable copper-zinc alloy that can be used for the jacket 105 is gilding metal, also referred to as Copper 210 Alloy. In other embodiments, the jacket 105 can include lead-free materials other than copper, such as bismuth, tungsten or iron, or any other suitable lead-free material. The jacket 105 may have relatively thin walls. Although the outer surface of the tail section 115 is co-planar with the outer surface of the intermediate section 131, the tail section 115 can have other shapes (e.g., a boat tail shape, a rebated boat tail shape, etc.).

Figure 2:
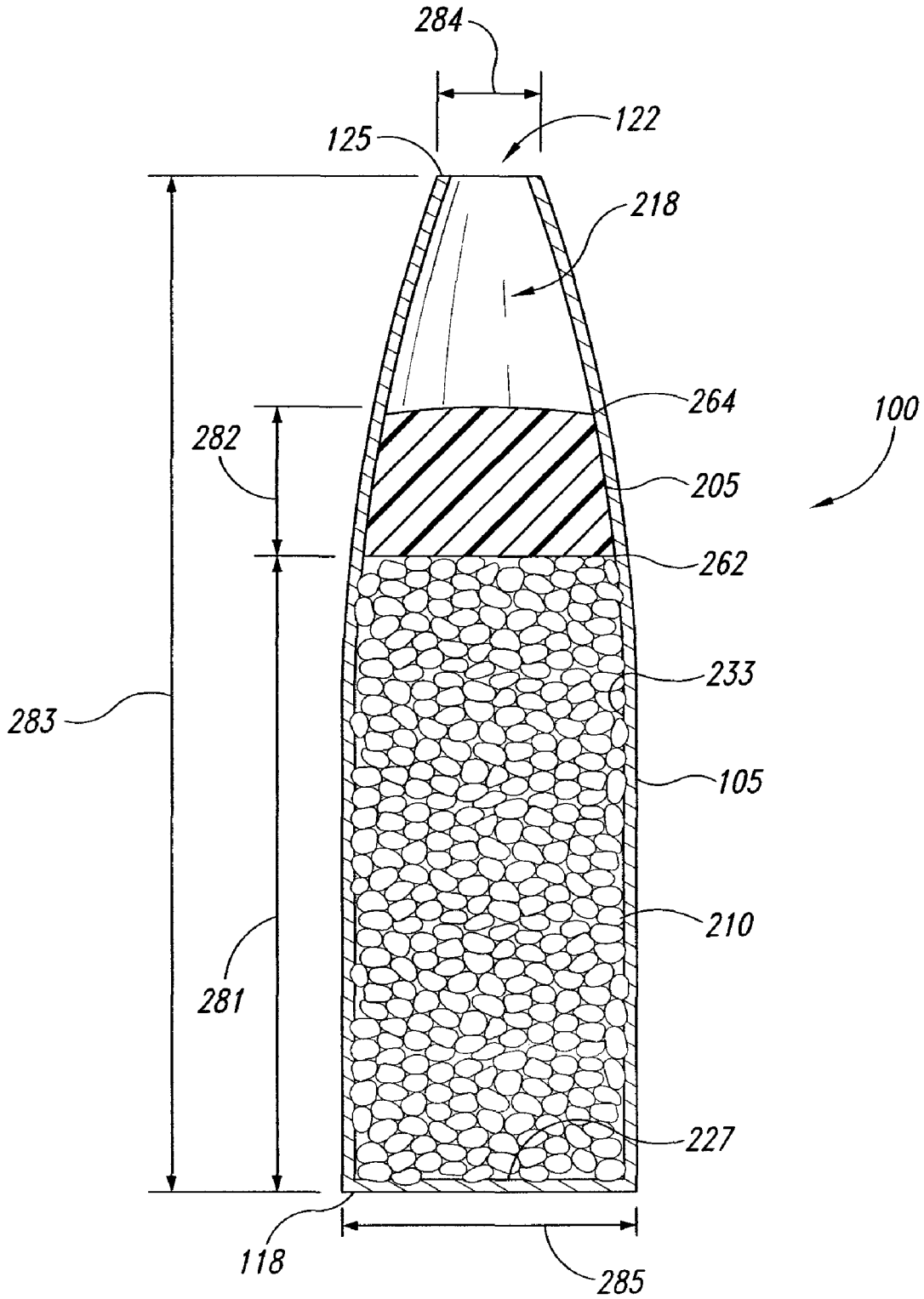
FIG. 2 is a cross-sectional side view taken along line 2-2 of the bullet illustrated in FIG. 1A.

FIG. 2 is a cross-sectional view taken along line 2-2 of the bullet 100 illustrated in FIG. 1A. Like reference numbers refer to like components in FIGS. 1A-1C and 2, and thus the description of such components will not be repeated with reference to the bullet 100 in FIG. 2. Referring to FIG. 2, the jacket 105 has an inner surface 233 at least partially defining a cavity 218 having a closed end 227 and an open end (the opening 122). The bullet 100 further includes a core 210 positioned within the cavity 218 from the closed end 227 to a first intermediate portion 262 of the cavity 218. In some embodiments, the core 210 includes a plurality of metal particles. For example, the metal particles may include iron, such as low-carbon steel. As another example, the metal particles may be made of non-ferrous material, such as copper, unalloyed copper or copper alloyed with another metal, such as zinc, or other suitable non-ferrous materials (e.g., tin, tungsten, bronze, brass, etc.). In some embodiments, the jacket 105 and/or the metal particles may include lead. In some embodiments, the core 210 may include metal particles of multiple types of metals, such as copper, tin, iron, lead, tungsten, bronze, brass, and other types of metals.

As described herein, the particles may be compacted, and substantially all or most of the particles may be substantially spherical (round) in shape before being compacted. Additionally or alternatively, substantially all or most of the particles may be non-spherical in shape (e.g., substantially elliptical, ovoid, cubical, and/or other substantially regular or irregular shapes, such as granules). The particles, prior to compaction, may have a nominal dimension (e.g., a diameter in the case of substantially spherical particles, or a maximum cross-sectional dimension in the case of non-spherical particles) that corresponds to one of the following Society of Automotive Engineers (SAE) shot sizes: SAE 70 (i.e., from about 0.003 inches (76 μm) to about 0.016 inches (405 μm)); SAE 110 (i.e., from about 0.005 inches (125 μm) to about 0.023 inches (600 μm)); SAE 170 (i.e., from about 0.012 inches (300 μm) to about 0.033 inches (850 μm)); or SAE 230 (i.e., from about 0.20 inches (500 μm) to about 0.038 inches (965 μm). In some embodiments, the nominal dimension of the particles may not correspond to any particular SAE shot size; instead the nominal dimension may be from about 0.003 inches (76 μm) to about 0.038 inches (965 μm). In some embodiments, the nominal dimension of the particles may be less than 0.003 inches (for example, the particles may be powdered metal particles) or greater than 0.038 inches.

The particles are approximately 85% to approximately 99.99% by weight of the core 210. In some embodiments, the particles comprise from approximately 95% to approximately 99.99% by weight of the core 210. In some embodiments, the particles may be NU SOFT Steel Shot supplied by GMA Industries of Romulus, Mich. Such particles have a hardness of less than 20 Rockwell C and a density ranging from about 7.0 g/cc to about 7.8 g/cc. In some embodiments, the metal particles are made of Copper 210 Alloy. Alternatively or additionally, the core 210 may include particles made from other suitable materials (e.g., glass, stainless steel, ceramics, etc.) having suitable properties. For example, the core 210 may include a mixture of particles made from one type of material (e.g., metal) and a mixture of particles made from another type of material (e.g., ceramics).

In some embodiments, the bullet 100 is a 22 caliber bullet having a height 283 of approximately 0.735 inches, a height 281 of the core 210 of approximately 0.470 inches, a height 282 of the seal 205 of approximately 0.100 inches, and a thickness of the jacket 105 of approximately 0.009 inches. The base 118 of the bullet 100 has a substantially circular cross-section with a diameter of approximately 0.224 inches and the substantially circular open end 122 has a diameter of approximately 0.080 inches.

Substantially all or most of the particles may have a single SAE size (e.g., SAE 110), or the particles may have two or more shot sizes, (e.g., SAE 110 and SAE 170). As previously noted, a particle, prior to compaction, may have a nominal dimension in the range of from about 0.003 inches to about 0.038 inches. In embodiments with particles of two or more different sizes, the two or more differently sized particles may be evenly distributed throughout the core 210 or unevenly distributed throughout the core 210. For example, smaller sized particles may be positioned within a forward portion of the core 210, and larger size particles may be positioned within a rearward portion of the core 210. Those of skill in the art will understand that a wide variety of ways to configure the particles in the core 210 are possible.

In some embodiments, the particles in the core 210 have a layer of additional material on the outer surfaces of the particles. The layer (alternatively referred to as layer material) may be uniform or non-uniform in thickness, and it may wholly or partially cover, coat, or otherwise be positioned on an outer surface of a particle. Examples of the layer include: a lubricant that coats the outer surfaces of the particles, a plating on the outer surface of the particles, an oxidation layer on the outer surfaces of the particles, and/or other materials that form a complete or partial layer on an outer surface of a particle. For example, particles comprised of copper may have a naturally-occurring oxide layer on the particles' outer surfaces (alternatively, the oxide layer may be formed by other than natural processes). As another example, the outer surfaces of the particles may be covered by zinc stearate. The layer may reduce the coefficient of friction between particles, thereby allowing them to move more freely relative to each other.

As described in more detail herein, the layer may serve at least two purposes. A first purpose is to enable the core 210 to be compacted. A second purpose is to enable the particles to separate from each other (alternatively referred to as releasing from each other) and from the jacket 105 when the bullet 100 impacts a target. Accordingly, the layer may function as a separation mechanism or agent (alternatively referred to as a release mechanism or agent) for the particles in the core 210.

For example, the layer may include one or more lubricants that cover the outer surfaces of the particles. One example of a lubricant that may cover the particles is zinc stearate. The zinc stearate may be in powder form, with the powder particles having a size ranging from about 0.1 μm to about 50 μm. The lubricant makes up from about 0.01% to about 15% by weight of the core 210. In some embodiments, the lubricant comprises from about 0.01% to about 5% by weight of the core 210. In some embodiments, the lubricant may be zinc stearate, Product No. SAK-ZS-TP, supplied by Silver Fern Chemical of Seattle, Wash. Alternatively or additionally, the core 210 may include other lubricants, such as molybdenum disulfide or graphite, or other lubricants known to those of skill in the art. The lubricant may evenly cover the particles (e.g., the lubricant may completely cover the entire surface of the particle), or may unevenly cover the particles (e.g., the lubricant may cover a portion of the entire surface of the particle). Additionally or alternatively, the lubricant may be adjacent to the particles throughout the core 210. The lubricant may also be substantially evenly distributed throughout the core 210 or may be unevenly distributed throughout the core 210.

In some embodiments, the layer may be formed by plating (e.g., using plating techniques known to those of skill in the art) the particles with another material. For example, particles that include copper may be plated with another metal to form a layer on the outer surfaces of the particles. In some embodiments, the layer may be an oxidation layer. For example, particles comprising iron may have an oxidation layer formed on their outer surfaces (e.g., by exposing the iron particles to oxygen and water or air moisture). As another example, particles comprising copper may have a naturally-occurring oxide layer on the particles outer surfaces. In some embodiments, the layer may include material formed on the outer surfaces of the particles by a chemical process. Those of skill in the art will understand that the layer may be formed using a variety of techniques.

In some embodiments, at least some of the particles may not have the layer. For example, particles that include copper may require little to no lubricant (or other layer material) in order for the particles to separate from each other (other than that layer material that is naturally occurring, such as a naturally occurring oxide layer on the copper particles). In some embodiments, the amount of the layer material (e.g., the amount of lubricant) may be inversely proportional to the nominal dimension of the particles. For example, particles having nominal dimensions at or near the lower limit of the particle size range (e.g., at or near about 0.003 inches) may require more lubricant in order to separate from each other than particles having nominal dimensions at or near the upper limit of the particle size range (e.g., at or near about to about 0.038 inches).

In some embodiments, the core 210 is formed by disposing the particles (coated or uncoated) within the cavity 218 and then compacting the particles within the cavity. For example, where the particles are covered with a lubricant, the core 210 is formed by mixing the particles with the lubricant so that the lubricant at least partially coats the particles, disposing the coated particles within the cavity 218, and then compacting the coated particles. As another example, where the particles are plated or coated with another material (e.g., another lubricant), the core 210 is formed by wholly or partially plating or coating the particles, disposing the coated particles within the cavity 218, and then compacting the coated particles.

Compacting the particles has at least two effects. A first effect is that the shape of the particles may change. For example, in the case of substantially spherical particles, upon compaction, the substantially spherical particles may change shape (e.g., become elliptical in shape, become tear-drop shaped, become ovoid, etc.) or become irregularly shaped (e.g., the substantially spherical particles may become spheroid with one or more flat spots or indentations on their outer surfaces). During compaction, the layer may enable the particles to more freely move relative to each other than they would be able to in the absence of the layer. A second effect of compacting the particles is that it reduces the number and/or the size of voids (e.g., empty pockets) in the cavity 218. For example, the particles may be compacted such that voids between particles are substantially eliminated, to produce a substantially void-free core 210 (in this context, substantially void-free means with cavities or voids in the core 210 that are substantially smaller than the particles in the core 210). This reduction in the number and/or the size of voids enables a greater number of particles to occupy the same volume within the cavity 218. Voids may have undesirable effects in that they may change the center of gravity of the bullet 100 such that the accuracy of the bullet 100 is negatively impacted. Therefore, it may be desirable to reduce the number and/or size of voids within the core 210. Accordingly, a compacted, substantially void-free core 210 may be more favorable than a non-compacted core that is not substantially void-free.

The bullet 100 may also include a seal 205 positioned within the cavity 218 from the first intermediate portion 262 to a second intermediate portion 264 of the cavity 218. The seal 205 may be made from various types of materials. For example, the seal 205 may include an adhesive, such as a light-cured adhesive that is cured by either the ultraviolet portion, the visible portion, or both portions of the light spectrum. For example, the light-cured adhesive may have photo initiators in both the ultraviolet and the visible light portions of the light spectrum. Other suitable types of adhesives that may be used include heat-cured adhesives, air-cured adhesives, and moisture-cured adhesives. Other types of materials may be used for the seal 205, such as sealants, one or two-part epoxies, acrylics, plastic adhesives or urethane adhesives. Other suitable sealing materials may be used for the seal 205. As can be seen in FIG. 2, the seal 205 abuts (is adjacent to) the inner surface 233 of the jacket 105. If viewed from above, a cross-section of the seal 205 would be seen to be generally circular, and the seal 205 would be seen to abut the inner surface 233 around substantially the entire perimeter of the inner surface 233.

Additionally or alternatively, the seal 205 may include polymeric material such as polymeric material having a shape of a ball or other shape. For example, a polypropylene ball, a polyethylene ball, a polyoxymethylene ball or a urethane ball may be used as the seal 205. Other types of polymeric material that may be used for the seal 205 include polyvinyl chloride, polyethylene terephthalate, polystyrene and polycarbonate, and other polymeric materials, such as thermoplastic polymers and organic polymeric material. Moreover, shapes other than balls (e.g., cylinders, ellipsoids, discs, etc.) may be used for the polymeric material. For example, polymeric material having a shape of a plug (e.g., a plug preformed to the shape of the cavity 218) could be used for the seal 205. As another example, polymeric material having an irregular shape may be used for the seal 205. For example, the seal 205 may have a generally spherical shape prior to disposition within the cavity 218, but the seal 205 may be compacted within the cavity. Compacting a seal 205 having a generally spherical shape may cause the seal 205 to change shape (e.g., to a roughly cylindrical shape).

Additionally or alternatively, a gasket made of suitable material may be used for the seal 205. For example, a gasket made of foam, neoprene, ethylene propylene diene M-class (EPDM), polyurethane, urethane, silicone, or a rubber compound (e.g., natural latex rubber, synthetic rubber, etc.) may be used for the seal. The gasket may have a regular shape (e.g., a ball, a cylinder, an ellipsoid, a plug, a disc, etc.) or an irregular shape. In other embodiments, other synthetic materials having suitable weight, strength, cost, manufacturing and/or other characteristics can be used for the seal 205.

Among other things, the seal 205 may prevent the ingress (alternatively referred to as the entrance or the entering) into the core 210 of foreign matter (e.g., dirt, moisture, other debris, etc.) through the open end 122 of the cavity 218. Put another way, the seal 205 may prevent foreign matter from contacting the core 210. Because such foreign matter may be prevented from entering the core 210, the core 210 may not be subject to environmental factors that have the potential to damage it or otherwise impair its integrity (e.g., cause metal particles to corrode or otherwise undesirably bind together, etc.). Accordingly, the seal 205 may assist in maintaining the integrity of the core 210 and thus the integrity of the bullet 100. The seal 205 may also assist in holding the core 210 in place within the cavity 218 prior to the bullet 100 striking a target. The seal 205 may also provide other advantages, such as increasing the weight of the bullet 100, shifting the center of mass of the bullet 100, and/or favorably changing the expansion characteristics of the bullet 100.

One function of the jacket 105 is to maintain the integrity of the core 210 up and until the bullet 100 impacts a target (e.g., through storage of the bullet 100, during the loading of the bullet 100 into a firearm, during the firing of the bullet 100, and during the flight of the bullet 100). When the bullet 100 impacts a target (e.g., animal tissue, a ballistic gelatin test medium, a target shooting target, etc.), the thin walls of the jacket 105 typically do not control the expansion of the bullet 100. Rather, the thin walls of the jacket 105 peel away from the seal 205 and the core 210, and/or otherwise rupture or deform upon impact. When the jacket 105 deforms, it no longer holds the core 210 together such that the particles in the core 210 can separate (e.g., release scatter, disperse, etc.) relative to each other and to the jacket 105. In embodiments where the particles in the core 210 are covered by a layer, the layer may aid in the separation of the particles. Such separation of the particles aids in the transmission of the kinetic energy of the bullet 100 to the intended target. Such separation also results in the dispersion of the particles across a larger area than would occur if the bullet had a solid core. An example of such dispersion is described with reference to e.g., FIG. 6.

Figure 3A:
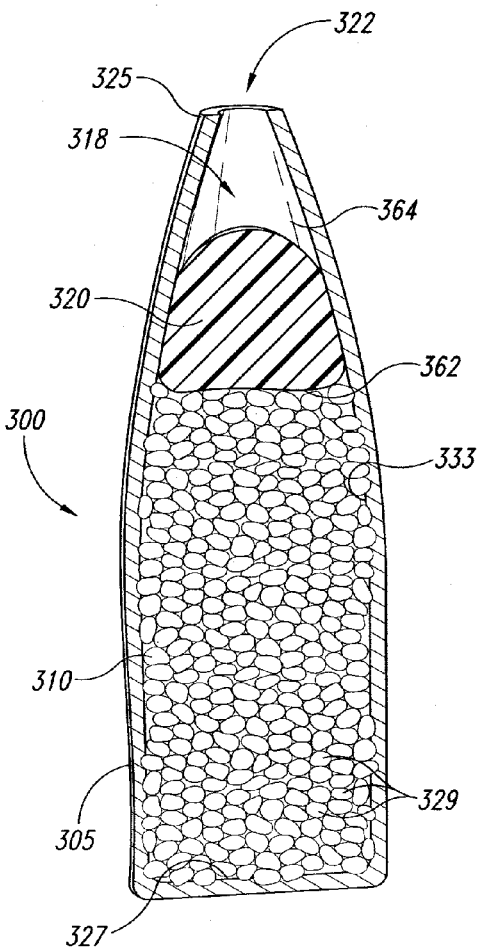
FIGS. 3A and 3B are cross-sectional side views of bullets in accordance with some embodiments.
Figure 3B:
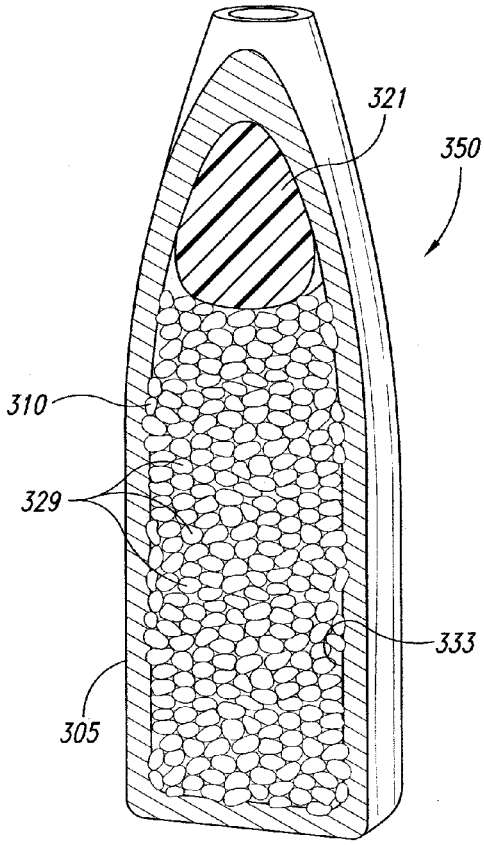

FIGS. 3A and 3B are cross-sectional side views of bullets 300 and 350 in accordance with some embodiments. Referring to FIG. 3A, the bullet 300 includes a jacket 305 having an inner wall 333 defining a cavity 318 having a closed end 327 and an open end 322. The bullet 300 also includes a core 310 disposed (positioned) within the cavity 318 from the closed end 327 to a first intermediate portion 362 of the cavity 318. The core 310 includes a plurality of metal particles 329 that have been mixed with a lubricant and compacted together within the cavity 318 to form the core 310. It can be seen that a number of the metal particles 329 are irregularly shaped (e.g., having flat spots formed by the pressure of other metal particles 329 upon them or by the pressure they exert upon an interior wall 333 of the jacket 305). It can also be seen that at least a portion of the core 310 has been compacted in such a way that it is substantially void-free (only having voids that are substantially smaller than the metal particles 329).

The bullet 300 also includes a polypropylene ball 320 disposed (positioned) within the cavity 318 from the first intermediate portion 362 of the cavity 318 to a second intermediate portion of the cavity 318. Referring to FIG. 3B, the bullet 350 is configured substantially the same as the bullet 300 of FIG. 3A. One difference is that the bullet 350 includes a ball 321 made of polyoxymethylene (trade name Delrin). At least portions of the outer surfaces of both the polypropylene ball 320 and the polyoxymethylene ball 321 abut (are adjacent to) the interior walls 333 of the jackets 305 of their respective bullets 300 and 350. This abutment of the balls 320/321 and the interior walls 333 may prevent foreign matter from accessing or entering the cores 310.

Figure 4A:
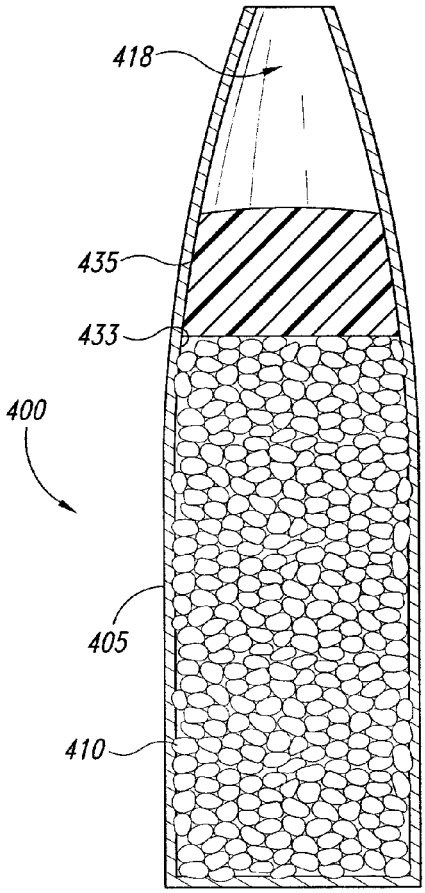
FIGS. 4A and 4B are cross-sectional side views of bullets in accordance with some embodiments.
Figure 4B:
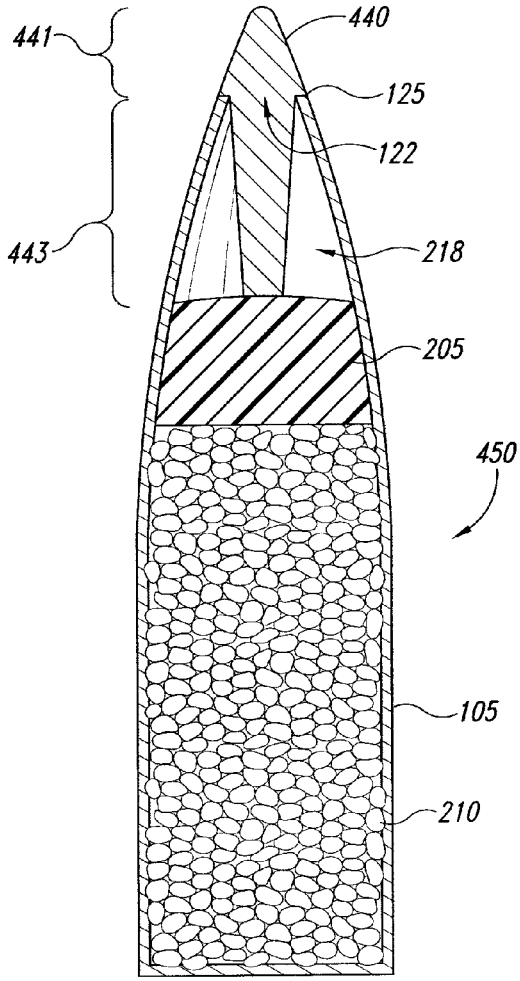

FIGS. 4A and 4B are cross-sectional side views of bullets 400 and 450 in accordance with some embodiments. Referring to FIG. 4A, the bullet 400 includes a jacket 405 defining a cavity 418 and a core 410 positioned within the cavity 418. The bullet also includes a gasket 435 made of suitable material (e.g., foam, neoprene, ethylene propylene diene M-class (EPDM), polyurethane, urethane, silicone, or a rubber compound). The gasket 435 substantially seals off the core 410, thereby preventing contamination or damage to it by foreign matter. Referring to FIG. 4B, the bullet 450 is configured substantially the same as the bullet 100 illustrated in FIG. 2A, with the addition of a tip 440 at the forward terminus 125. The tip 440 includes a forward portion 441 that projects forward from the opening 122 and a rearward portion 443 that extends rearward from the opening 122 into the cavity 218. The rearward portion 443 is shown as extending rearward into the cavity 218 such that it abuts the seal 205, but it may extend rearward into the cavity 218 such that it stops short of engaging the seal 205. Alternatively, the rearward portion 443 may partially or completely extend into the seal 205.

The tip 440 may have one of several tip styles, such as spitzer, semi spitzer, and/or round nose. The tip 440 can be composed of a polymeric substance, such as the polymeric materials described herein (e.g., thermoplastic polymeric material). In some embodiments, the tip 440 is colored differently according to the caliber of the bullet. For example, a 30-caliber bullet can have a tip with a green hue, and other calibers can have tips of different colors. A user can thus easily determine the caliber of a bullet by the color of the tip 440. In other embodiments, however, the color of the tip 440 can be uniform across several calibers. The tip 440 can prevent deformation in a magazine containing the bullet, enhance the aerodynamic efficiency of the bullet and initiate the expansion of the bullet 100 upon impact (e.g., by forcing itself into the core 410, thereby causing the particles to separate from each other).

Figure 7A:
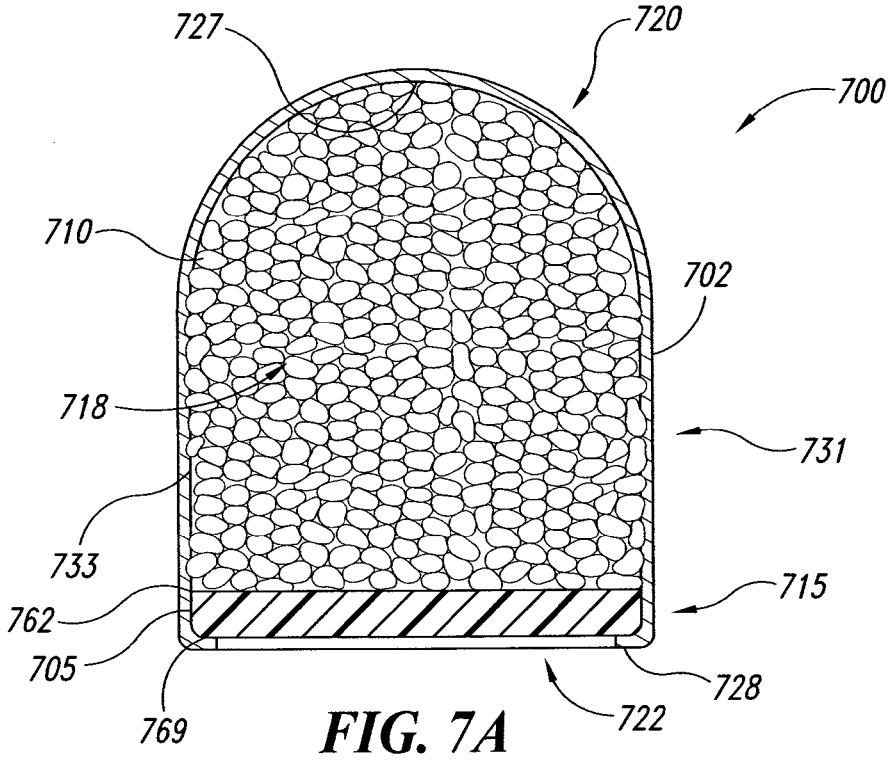
FIG. 7A is an enlarged cross-sectional side view.
Figure 7B:
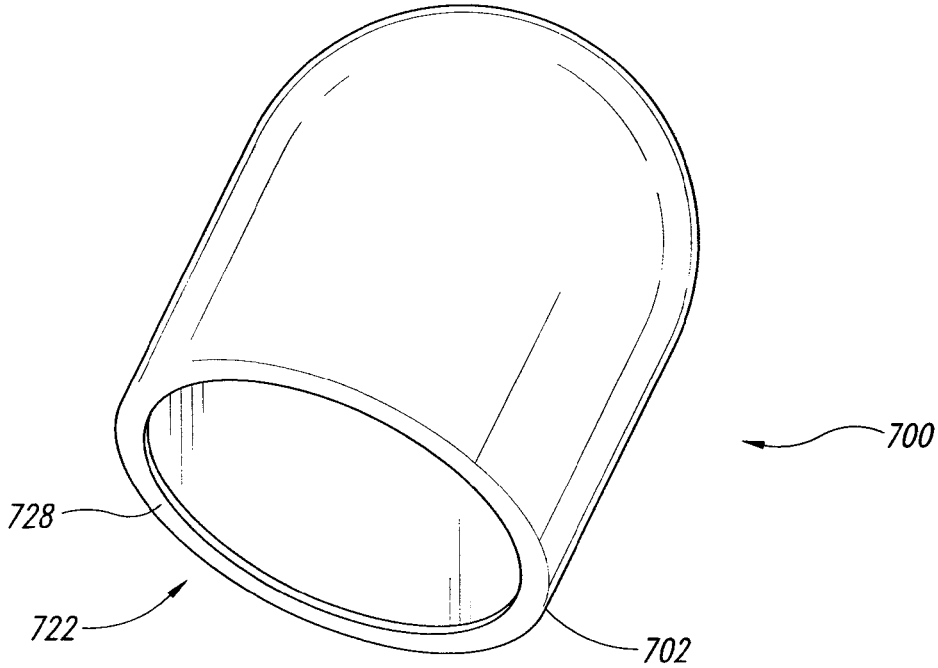
FIG. 7B is an enlarged isometric view, of a bullet in accordance with an embodiment.

FIG. 7A is an enlarged cross-sectional side view, and FIG. 7B is an enlarged isometric view, of a bullet 700 in accordance with an embodiment. The bullet 700 includes a jacket 702 having a nose section 720, an intermediate section 731 and a tail section 715. The nose section 720 has an outer surface that is continuously ogived (without any openings). The tail section 715 terminates in a generally annular base 728 defining an opening 722. The jacket 702 has an inner surface 733 at least partially defining a cavity 718 extending from the opening 722 to a closed end 727 at the nose section 720. The bullet 700 also includes a core 710. The core 710 substantially fills the cavity 718 from the closed end 727 to a first intermediate portion 762 of the cavity 718. The bullet 700 also includes a seal 705 positioned from the first intermediate portion 762 to a second intermediate portion 764 proximate to the annular base 728. Among other things, the seal 705 may retain the core 710 in place within the cavity 718 and may protect the core 710 from potential damage or contamination. The annular base 728 may retain the seal 705 in place within the cavity 718. Excepting the opening 722 at the annular base 728, the jacket 702 substantially encloses the core 710 and the seal 705.

The jacket 702, the core 710, and the seal 705 may be composed of any of the material or materials described herein and/or other suitable materials. For example, the jacket 702 may include copper and the core 710 may include a compacted plurality of particles (e.g., copper particles having a dimension, prior to compaction, of from about 0.003 inches to about 0.038 inches) that are at least partially covered with a layer of material, such as zinc stearate. As another example, the seal 705 may include an adhesive, or polymeric material having a generally disk-like shape that may or may not be compacted within the cavity 718. The bullet 700 may be formed by, for example, positioning the core 710 within the cavity 718, positioning the seal 705 proximate to the core 710, and then forming the annular base 728. The annular base 728 may be formed by, for example, crimping the jacket 702 at the tail section 715, or by any other suitable method. Other suitable methods may also be used to form the bullet 700.

Figure 8B:
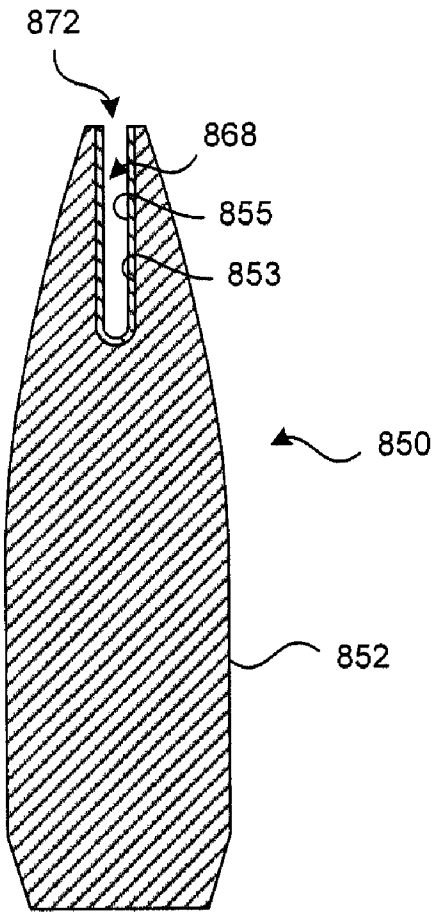
FIGS. 8A and 8B are enlarged cross-sectional side views of bullets in accordance with some embodiments.
Figure 8A:
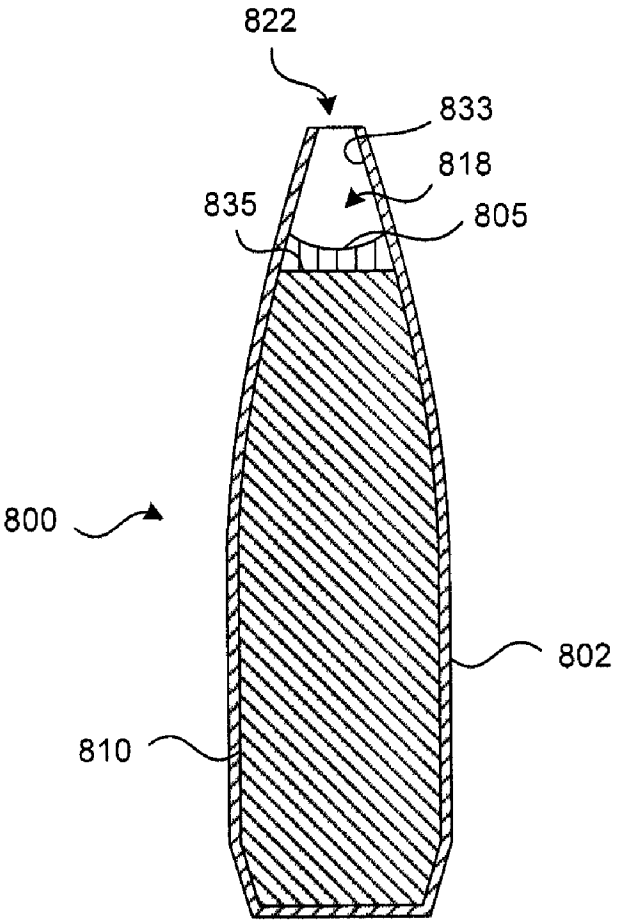

FIGS. 8A and 8B are enlarged cross-sectional side views of bullets 800 and 850 in accordance with embodiments. Referring to FIG. 8A, the bullet 800 includes a body formed of a jacket 802 and a core 810. The jacket 802 has an inner surface 833 that at least partially defines a cavity 818 extending from an opening 822. The core 810 partially fills the cavity 818. The core 810 may be bonded or otherwise attached to the jacket 802 by an adhesive (not shown). The core 810 has a surface 835 that is positioned toward the opening 822. The bullet 800 also includes sealing material 805 positioned within the cavity 818. The sealing material 805 covers at least a portion of the surface 835 of the core 810. The sealing material 805 may also cover at least a portion of the surface 833 of the jacket 802. In some embodiments, the sealing material 805 does not completely fill the portion of the cavity 818 that is not occupied by the core 810. Put another way, the sealing material 805 does not entirely close off the opening 822. In some embodiments, the sealing material 805 completely fills the portion of the cavity 818 that is not occupied by the core 810, and may or may not extend beyond the opening 822.

The jacket 802 may be composed of any of the material or materials described herein and/or other suitable materials. For example, the jacket 802 may include copper (for example, Copper 210 alloy). The core 810 may also be composed of any of the material or materials described herein and/or other suitable materials. For example, the core 810 may be composed of multiple metal particles and/or metal powder. As another example, the core 810 may be a continuous, unitary, piece of metal or multiple pieces of metal. Suitable metals include copper or copper alloys, lead or lead alloys, iron or iron alloys; other types of suitable materials may also be used for the core 810. The sealing material 805 may include any of the materials described herein, such as adhesives, sealants, etc, and/or other suitable sealing materials.

The sealing material 805 has a solid state (the sealing material 805 is solid). Prior to having a solid state, the sealing material 805 had a non-solid state. For example, the sealing material 805 may include an adhesive that had a liquid or semi-liquid state prior to changing to a solid state. For example, the adhesive may include a light-cured adhesive that has a certain viscosity prior to being cured by exposure to light and solidifying. As another example, the sealing material 805 may include a sealant that had a liquid or semi-liquid state prior to changing to a solid state. For example, the sealant may include a sealant that hardens upon exposure to air or light. (The term phase may be used as an alternative to state. For example, the sealing material 805 may be said to have a solid phase but previously had a non-solid phase.)

Among other things, the sealing material 805 may prevent the ingress (alternatively referred to as the entrance or the entering) into the core 810 of foreign matter (e.g., dirt, moisture, other debris, etc.) through the opening 822 of the cavity 818. Put another way, the sealing material 805 may prevent foreign matter from contacting the core 810. Because such foreign matter may be prevented from entering the core 810, the core 810 may not be subject to environmental factors that have the potential to damage it or otherwise impair its integrity (e.g., cause the core 810 to corrode or otherwise be damaged). Accordingly, the sealing material 805 may assist in maintaining the integrity of the core 810 and thus the integrity of the bullet 800. The sealing material 805 may also assist in holding the core 810 in place within the cavity 818 prior to the bullet 800 striking a target. The sealing material 805 may also provide other advantages, such as increasing the weight of the bullet 800, shifting the center of mass of the bullet 800, and/or favorably changing the expansion characteristics of the bullet 800.

Referring to FIG. 8B, the bullet 850 includes a body 852. The body 852 has a surface 853 that at least partially defines a cavity 868 extending from an opening 872. The bullet 850 also includes sealing material 855 positioned within the cavity 868. The sealing material 855 is positioned on at least a portion of the surface 853. In some embodiments, the sealing material 855 does not entirely fill the cavity 855. Put another way, the sealing material 855 does not entirely close off the opening 872. In some embodiments, the sealing material 855 completely fills the cavity 855, but does not extend beyond the opening 872. The body 852 may be composed of any of the material or materials described herein and/or other suitable materials. For example, the body 852 may be a continuous, unitary, piece of metal or multiple pieces of metal. Suitable metals include copper or copper alloys, lead or lead alloys, iron or iron alloys; other types of suitable materials may also be used for the body 852. The sealing material 855 may be substantially similar to the sealing material 805 of FIG. 8A.

Among other things, the sealing material 855 may prevent foreign matter (e.g., dirt, moisture, other debris, etc.) that enters through the opening 872 from contacting the portion of the surface 853 on which the sealing material 855 is positioned. Accordingly, the sealing material 855 may assist in maintaining the integrity of the body 852 and thus the integrity of the bullet 850. The sealing material 855 may also provide other advantages, such as increasing the weight of the bullet 850, shifting the center of mass of the bullet 850, and/or favorably changing the expansion characteristics of the bullet 850.

Figures 5A, 5B, 5C, 5D:
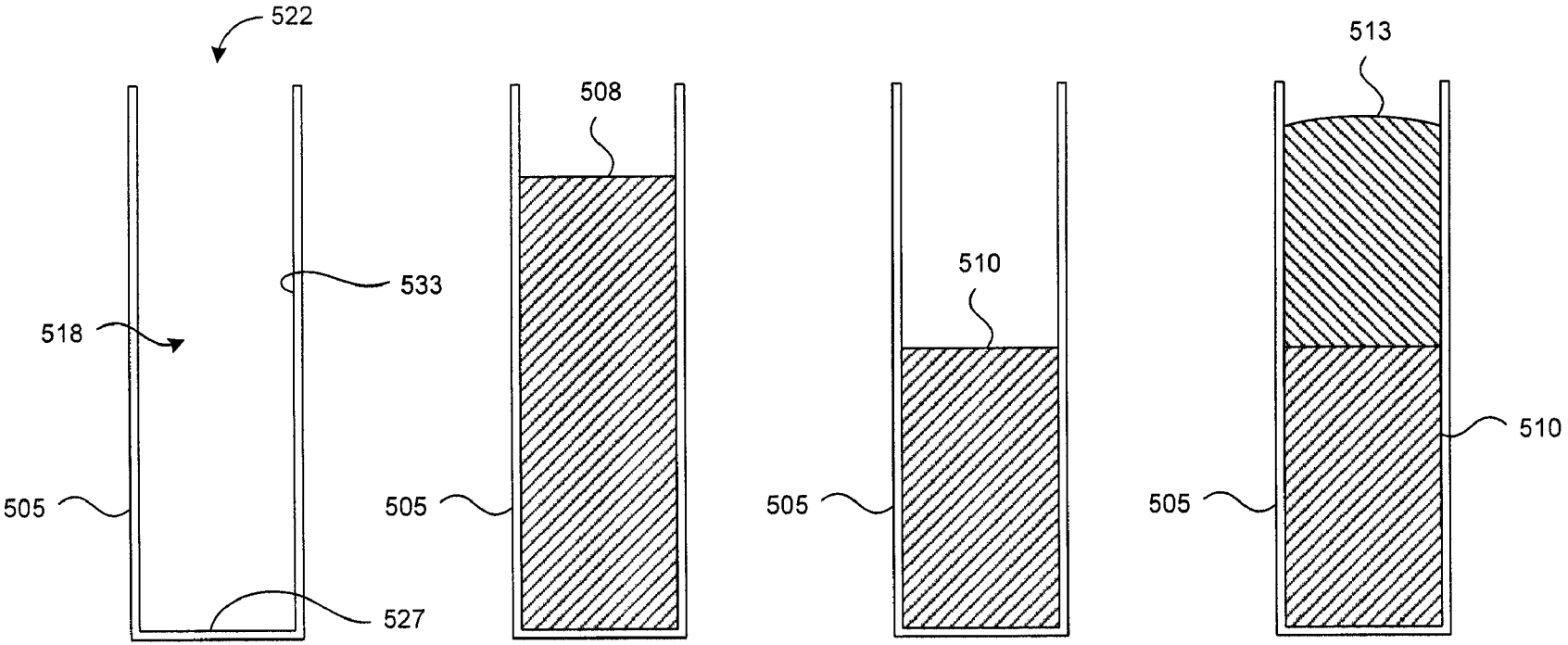
FIGS. 5A-5G are cross-sectional side views of various stages of a method for manufacturing a bullet in accordance with an embodiment.

FIGS. 5A-5G are cross-sectional side views of various stages of a method for manufacturing a bullet in accordance with an embodiment. In FIG. 5A, a jacket 505 has been formed, the jacket 505 having an interior surface 533 defining a cavity 518 having an open end 522 and a closed end 527. The jacket 505 may be formed by cup and draw operations (not shown) or by other techniques for forming bullet jackets. In FIG. 5B, a plurality 508 of particles (e.g., metal particles that are coated or uncoated, such as with a lubricant, a plating, an oxidation layer, and/or other materials) is disposed within the cavity 518 through the open end 522 of the cavity 518. The particles may have been previously screened using American Society for Testing and Materials (ASTM) screens and/or other screens (e.g., vibrating screens). For example, ASTM mesh nos. 40-120 may be used to screen SAE 70 particles; ASTM mesh nos. 30-80 may be used to screen SAE 110 particles; ASTM mesh nos. 20-50 may be used to screen SAE 170 particles; and ASTM mesh nos. 18-40 may be used to screen SAE 230 particles. Furthermore, as noted herein, the intended dispersion of the core particles upon impacting a target may be a function at least partly of the particle size. An intended dispersion may be determined, and the sizes of the core particles may be selected based upon this intended dispersion.

Figure 5G:
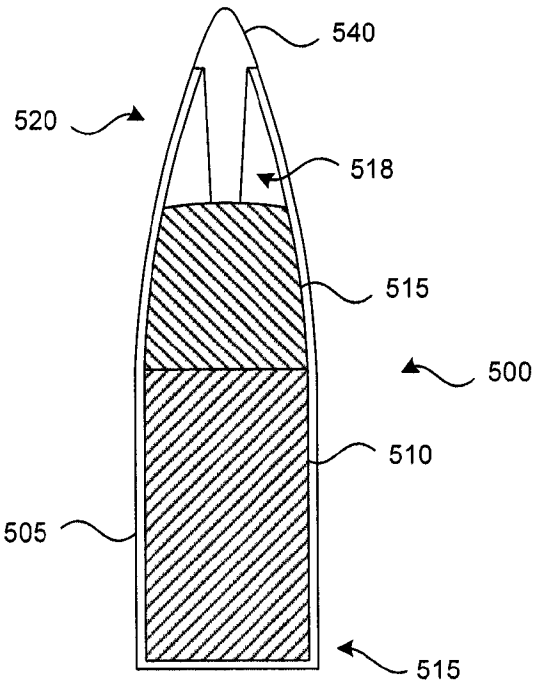

As previously noted in some embodiments, the plurality 508 of particles may be at least partly covered by a layer of material, such as a lubricant (e.g., zinc stearate, an oxide layer, etc.). In FIG. 5C, the plurality 508 of particles is tamped or otherwise compacted by a punch (not shown) to compress it within the cavity 518, thereby forming a compacted core 510 of particles. In some embodiments, the plurality 508 of particles is tamped or compacted at an ambient temperature. The layer of material may aid in the compaction of the particles by enabling the particles to more easily move relative to each other than they would without a layer of material. In FIG. 5D, a seal 513 is disposed within the cavity over the core 510. For example, a liquid adhesive may be dispensed over the core 510. As another example, a polymeric ball or a gasket may be placed over the core 510. In FIG. 5E, if the seal 513 is an adhesive that requires curing, it is cured to result in a seal 515. If the seal 513 is a mechanical seal such as a polymeric ball or a gasket, it may be tamped or otherwise have pressure applied to it (e.g., by a punch, not shown) to properly position it within the cavity 518, thereby resulting in the seal 515. The perimeter of the seal 515 abuts the inner surface 533 of the jacket 505, thereby substantially sealing the core 510 within the cavity 518. In some embodiments, the step of disposing a seal within the cavity 518 is omitted. For example, if the particles include copper, tamping forces that are higher than those used for iron particles may be used to compact the plurality 508 of particles. The higher tamping forces may result in a core 510 that is held in place within the cavity 518 without the use of a seal.

Figure 5F:
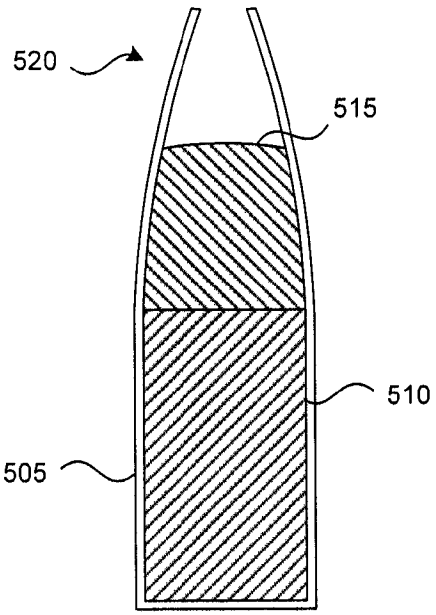
Figure 5E:
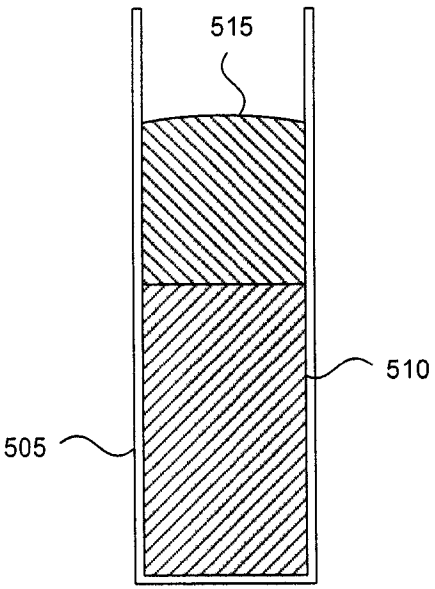

In FIG. 5F, an ogiving operation is performed upon the jacket 505 (e.g., by placing the jacket 505 in an ogive die cavity and applying an axial force to its base) to form a nose portion 520. In FIG. 5G, a tip 540 is inserted into the cavity 518.

While the steps in FIGS. 5A-5G are presented in a given order, alternative embodiments may perform steps in different orders, and some steps may be skipped, moved, added, combined, and/or modified. For example, to form the bullet 700 illustrated in FIGS. 7A and 7B, the nose portion 720 may be formed prior to positioning the core 710 within the cavity 718. Each of these steps may be implemented in a variety of different ways. Also, while steps are shown as being performed in series, these steps may instead be performed in parallel, or may be performed at different times.

Figure 9:
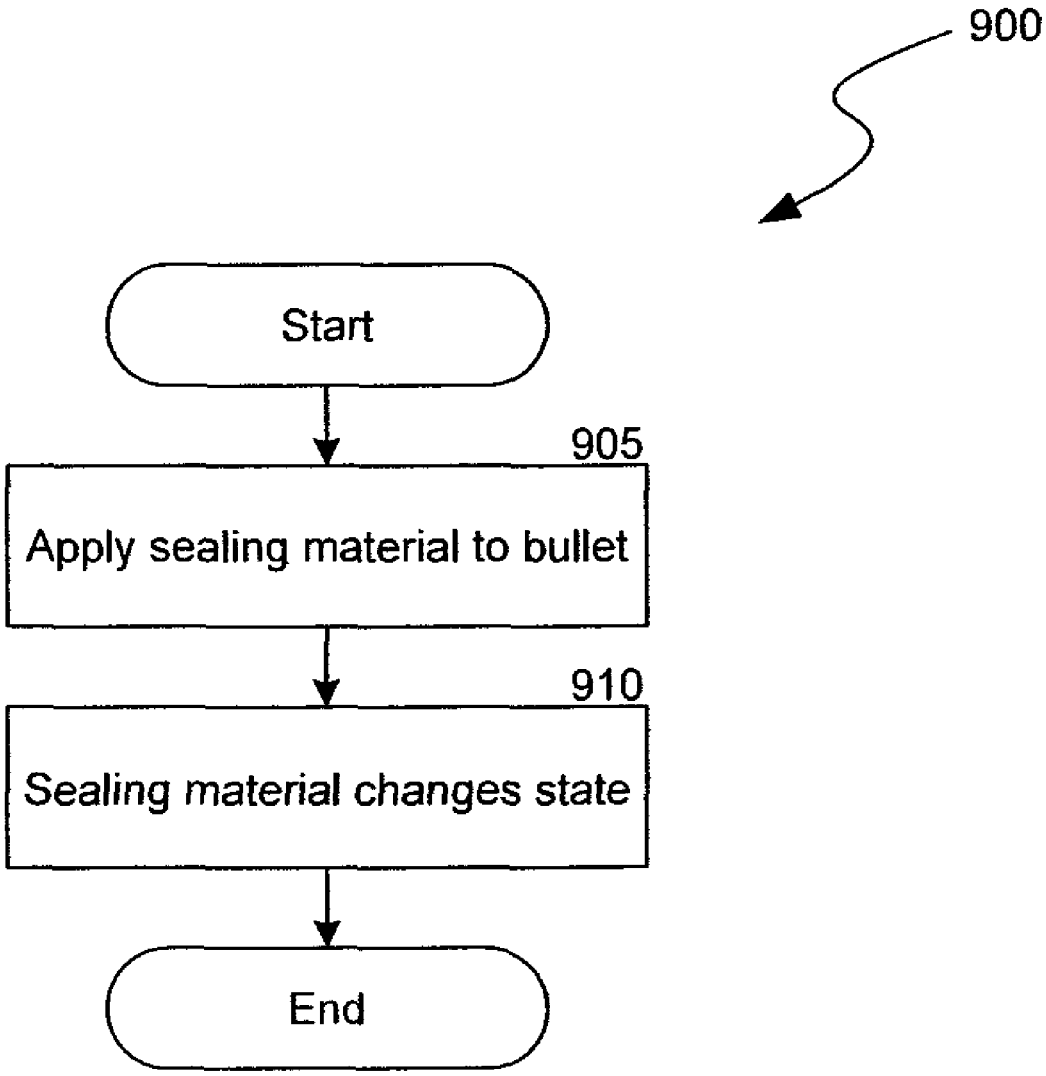
FIG. 9 is a flow diagram of a process for forming sealing material on a bullet in accordance with some embodiments.

FIG. 9 is a flow diagram of a process 900 for forming sealing material on a bullet in accordance with some embodiments. The process 900 begins at step 905 where sealing material is applied to a bullet having a cavity. The bullet may be configured in accordance with an embodiment described herein, or may have other configurations. The sealing material has a non-solid state at the time it is applied to the bullet. The process continues at step 910, where the state of the sealing material changes from non-solid to solid. For example, the sealing material may be an adhesive or sealant that cures upon exposure to heat, air, moisture, or light. The changing of the state of the sealing material may occur without active intervention (e.g., upon natural exposure to a curing agent such as air, light, moisture, etc.) or may be actively caused (e.g., upon actively exposing the sealing material to a curing agent such as air, light, moisture, etc.). After step 910, the process 900 then concludes.

Those skilled in the art will appreciate that the steps shown in FIG. 9 may be altered in a variety of ways. For example, the order of the steps may be rearranged; substeps may be performed in parallel; shown steps may be omitted, or other steps may be included; etc.

Figure 6:
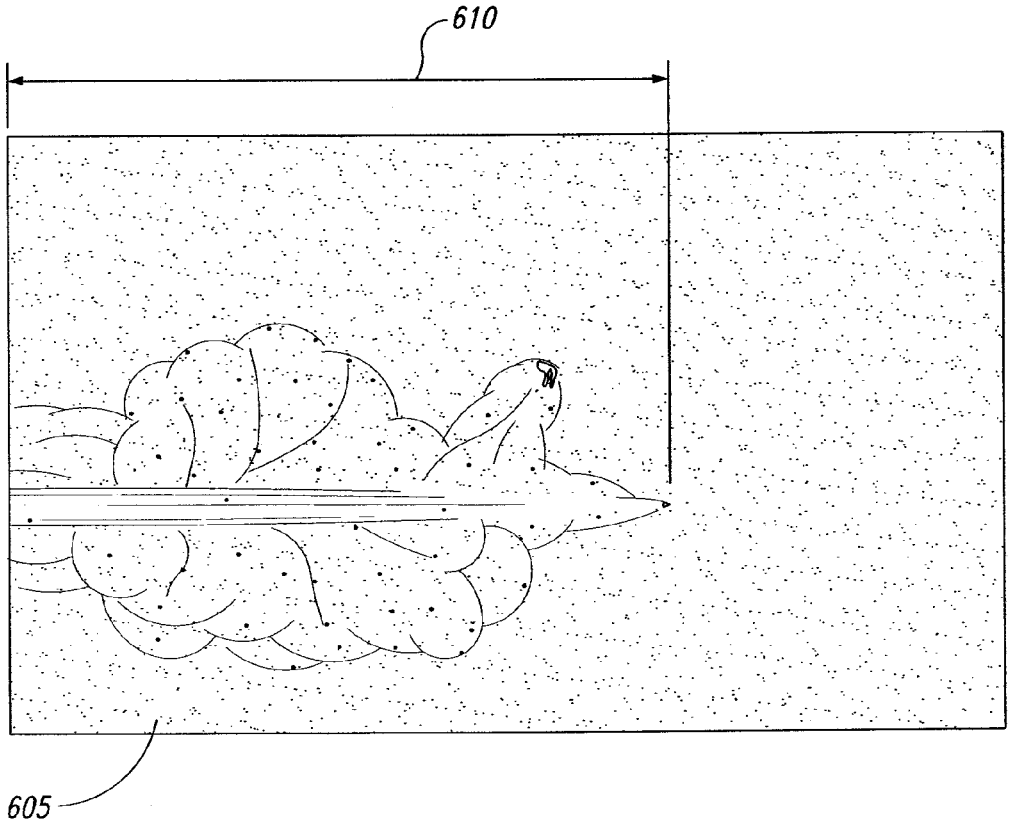
FIG. 6 is a side view of a ballistic gelatin test medium impacted by a bullet in accordance with an embodiment.

FIG. 6 is a side view of a 22 caliber, 40 grain bullet that has impacted a ballistic gelatin test medium 605 at a velocity of approximately 3500 feet per second (fps), which roughly corresponds to an impact in animal tissue of a shot taken at a distance of approximately 50 yards when fired from a 22-250 firearm. Prior to impact, the bullet had a thin-walled jacket surrounding a core having approximately 99.5% by weight SAE 110 particles and approximately 0.5% by weight zinc stearate, and a UV-cured adhesive sealing off the core. The thin-wall jacket of the bullet enables the frangible core of the bullet to widely disperse upon impacting the medium 605. The frangible core of the bullet extended approximately six inches into the medium 605, which is indicated by reference character 610. It can be seen from FIG. 6 that the bullet provides both penetration (the depth within the medium 605 reached by the core particles) and scattering of the particles from the center axis of the bullet's path into the medium, such scattering radiating outwardly from the direction of travel of the bullet into the medium 605 with no to minimal ricochet of the particles. Such combination of penetration and scattering is referred to as the dispersion of the bullet. A bullet's dispersion in a target is determined by several factors, including the thickness of its jacket, its entry speed, its caliber, the size of the opening at its forward terminus, the size of its particles, the distribution between the amount of the particles and the amount of the layer material (e.g., lubricant) within its core, and/or other factors. Certain factors may have more or less of an effect upon the bullet's dispersion than other factors. For example, for intended applications that require greater depth penetration (e.g., hunting certain animals), these and other factors may be configured to produce a bullet having the intended result. As another example, for intended applications that require less depth penetration (e.g., target practice shooting), certain factors may be configured to produce a bullet having the intended result. Accordingly, factors can be selected or configured to produce bullets in accordance with the requirements of the intended application. This enables the production of bullets for use in a wide variety of applications.

From the foregoing description, it will be appreciated that specific embodiments have been described herein for purposes of illustration, but that various modifications may be made to these embodiments. Further, while advantages associated with certain embodiments have been described in the context of those embodiments, other embodiments may also exhibit such advantages, and not all embodiments need necessarily exhibit such advantages. Accordingly, the disclosure can include other embodiments not shown or described herein.

We claim:

1. A bullet comprising:

a jacket defining a cavity having a closed end and an open end;

a core positioned within the cavity and extending from the closed end to a first intermediate portion of the cavity, the core including a plurality of particles, the particles having outer surfaces and a dimension of from about 0.003 inches to about 0.038 inches;

a seal positioned within the cavity and extending from the first intermediate portion of the cavity to a second intermediate portion of the cavity, wherein the second intermediate portion of the cavity is spaced apart from the open end of the cavity; and a material positioned on at least portions of the outer surfaces of the particles, wherein the material is configured to lubricate the particles during compaction within the cavity and to facilitate separation of the particles after an impact.

2. The bullet of claim 1, further comprising a tip having a forward portion projecting forward from the open end and a rearward portion extending rearward into the cavity.

3. The bullet of claim 1 wherein the jacket includes copper.

4. The bullet of claim 1 wherein the plurality of particles are compacted within the cavity.

5. The bullet of claim 1 wherein at least some of the particles have been compacted, and wherein the at least some of the particles have a generally spherical shape prior to compaction.

6. The bullet of claim 1 wherein at least some of the particles have an irregular shape.

7. The bullet of claim 1 wherein the at least some of the particles include copper.

8. The bullet of claim 1 wherein at least some of the particles include iron.

9. The bullet of claim 1 wherein at least some of the particles include non-ferrous material.

10. The bullet of claim 1 wherein the material includes at least one of molybdenum disulfide, graphite and zinc stearate.

11. The bullet of claim 1 wherein the material includes a metallic coating applied through a plating process.

12. The bullet of claim 1 wherein the material includes oxidized material.

13. The bullet of claim 1 wherein the plurality of particles form from about 85% to about 99.99% of the core by weight, and wherein the material forms from about 0.01% to about 15% of the core by weight.

14. The bullet of claim 1 wherein the seal includes an adhesive.

15. The bullet of claim 1 wherein the seal includes a light-cured adhesive.

16. The bullet of claim 1 wherein the seal includes at least one of a heat-cured adhesive, an air-cured adhesive, and a moisture-cured adhesive.

17. The bullet of claim 1 wherein the seal includes an epoxy.

18. The bullet of claim 1 wherein the seal includes polymeric material.

19. The bullet of claim 18 wherein the polymeric material includes at least one of polypropylene, polyethylene, polyoxymethylene and urethane.

20. The bullet of claim 18 wherein the seal is compacted, and wherein the seal has a substantially spherical shape prior to compaction.

21. The bullet of claim 1 wherein the seal includes a gasket.

22. The bullet of claim 1 wherein the seal includes at least one of foam, neoprene, ethylene propylene diene M-class (EPDM), polyurethane, urethane, silicone, and a rubber compound.

23. The bullet of claim 1 wherein the seal prevents ingress into the core of foreign material entering through the open end of the cavity.

24. The bullet of claim 1 wherein the jacket has a nose section, and a tail section having a generally annular base, wherein the generally annular base defines the open end of the jacket, and wherein the second intermediate portion of the cavity is proximate to the generally annular base.

25. The bullet of claim 24 wherein the tail section is crimped to form the generally annular base.

26. A bullet comprising:

a lead-free jacket having a tail section with a base, an intermediate section extending from the tail section, a nose section having an ogived outer surface extending from the intermediate section to a terminus, an opening at the terminus, and an inner surface defining a cavity extending from the opening to the base;

a lead-free core positioned within the cavity, the lead-free core extending from the base to an intermediate portion of the cavity, and the lead-free core including— a plurality of compacted metal granules having outer surfaces, the metal granules, prior to compaction, having a dimension of from about 0.003 inches to about 0.038 inches; and a layer on at least portions of the outer surfaces of the metal granules, the layer configured to lubricate the granules during compaction within the cavity and to facilitate separation of the granules after an impact; and a seal positioned adjacent the lead-free core, wherein the seal is spaced apart from the opening at the terminus.

27. The bullet of claim 26, further comprising a tip in the opening having a forward portion projecting forward from the opening and a rearward portion extending rearward into the cavity.

28. The bullet of claim 26 wherein the tip has a style that includes one of a spitzer style, a semi spitzer style, and a round nose style.

29. The bullet of claim 26 wherein the jacket includes copper.

30. The bullet of claim 26 wherein the jacket includes copper 210 alloy.

31. The bullet of claim 26 wherein the plurality of metal granules are compacted within the cavity.

32. The bullet of claim 26 wherein at least some of the metal granules have a substantially spherical shape prior to compaction.

33. The bullet of claim 26 wherein at least some of the metal granules have an irregular shape.

34. The bullet of claim 26 wherein at least some of the metal granules include iron.

35. The bullet of claim 26 wherein at least some of the metal granules include carbon steel.

36. The bullet of claim 26 wherein at least some of the metal granules include non-ferrous material.

37. The bullet of claim 26 wherein at least some of the metal granules include copper.

38. The bullet of claim 26 wherein the layer includes at least one of molybdenum disulfide, graphite and zinc stearate.

39. The bullet of claim 26 wherein the layer includes a metallic coating.

40. The bullet of claim 26 wherein the layer includes oxidized material.

41. The bullet of claim 26 wherein the intermediate portion of the cavity is a first intermediate portion of the cavity, and wherein the extends from the first intermediate portion of the cavity to a second intermediate portion of the cavity, the seal abutting the inner surface of the lead-free jacket to substantially seal off the lead-free core within the cavity.

42. The bullet of claim 41 wherein the seal includes a light-cured adhesive.

43. The bullet of claim 41 wherein the seal includes at least one of a heat-cured adhesive, an air-cured adhesive, and a moisture-cured adhesive.

44. The bullet of claim 41 wherein the seal includes polymeric material.

45. The bullet of claim 41 wherein the seal includes polymeric material, wherein the seal is compacted, and wherein the seal has a substantially spherical shape prior to compaction.

46. The bullet of claim 41 wherein the seal includes a gasket.

47. The bullet of claim 41 wherein the seal includes at least one of foam, neoprene, ethylene propylene diene M-class (EPDM), polyurethane, urethane, silicone, and a rubber compound.

48. The bullet of claim 41 wherein the seal prevents ingress into the lead-free core of foreign matter that enters the cavity through the opening at the terminus.

49. A bullet comprising:

a body including— a core having a plurality of metal particles;

a jacket having an opening and a surface at least partially defining a cavity; and, a material in contact with the metal particles, the material configured to lubricate the metal particles during compaction within the jacket and to facilitate separation of the particles after an impact; and sealing material positioned on at least a portion of the surface and on at least a portion of the core, wherein— the sealing material has a solid state, the sealing material previously had a non-solid state, the sealing material on the core is spaced apart from the opening, and the sealing material prevents foreign matter that enters the cavity through the opening from contacting the portion of the surface and the portion of the core.

50. The bullet of claim 49 wherein the multiple metal particles have a dimension of from about 0.003 inches to about 0.038 inches.

51. The bullet of claim 49 wherein the core includes metal powder.

52. The bullet of claim 49 wherein the body is a unitary piece of material.

53. The bullet of claim 49 wherein the sealing material includes an adhesive.

54. The bullet of claim 53 wherein the adhesive includes a light-cured adhesive.

55. The bullet of claim 49 wherein the sealing material includes a sealant.

56. The bullet of claim 49 wherein the sealing material includes at least one of an adhesive and a sealant, wherein the body includes a tail section having a generally annular base, and wherein the generally annular base defines the opening.

57. A bullet comprising:

a body including— a core having a plurality of particles;

a jacket having an opening and a surface at least partially defining a cavity; and a layer positioned on the particles, the layer configured to lubricate the particles during compaction within the jacket and to facilitate separation of the particles after an impact; and means for sealing at least a portion of the surface, wherein— the means for sealing has a solid state, the means for sealing previously had a non-solid state, the means for sealing is positioned on the portion of the surface and on at least a portion of the core, and the means for sealing is spaced apart from the opening and does not close the opening.

58. The bullet of claim 57 wherein the plurality of particles includes metal particles.

59. The bullet of claim 57 wherein the core includes metal powder.

60. The bullet of claim 57 wherein the means for sealing includes an adhesive.

* * * * *